United States Patent [19]

Stevens et al.

[11] 4,123,633

[45] Oct. 31, 1978

[54] SWITCH-VALVE ASSEMBLY HAVING ROTATABLE OPERATING MECHANISM WITH LATCH

[75] Inventors: Joe M. Stevens, Thompson Station; Elmer D. Porter, Franklin, both of Tenn.

[73] Assignee: Essex Group, Inc., Fort Wayne, Ind.

[21] Appl. No.: 787,195

[22] Filed: Apr. 13, 1977

[51] Int. Cl.[2] ..... H01H 9/06

[52] U.S. Cl. ..... 200/61.86; 431/256

[58] Field of Search ..... 200/6 B, 61.86, 318; 431/256; 129/39 E

[56] References Cited

U.S. PATENT DOCUMENTS

| | | | |
|---|---|---|---|
| 2,399,033 | 4/1946 | Hudson | 200/61.86 |
| 2,591,626 | 4/1952 | Sloan | 431/256 X |
| 3,122,616 | 2/1964 | Rice et al. | 200/61.86 |
| 3,436,165 | 4/1969 | Gehrke | 431/256 |
| 3,971,904 | 7/1976 | Ward | 200/61.86 X |

*Primary Examiner*—James R. Scott

*Attorney, Agent, or Firm*—Lawrence E. Freiburger; Robert D. Sommer

[57] ABSTRACT

A valve and switch assembly having a rotatably movable actuating mechanism in common. The actuating mechanism acts to actuate both devices when rotated. A latch mechanism, however, prevents rotation of the actuating mechanism when it is rotated to a first position. The latch is deactuated by axially depressing or collapsing the actuating mechanism and then rotating it. An additional unique feature lies in the switch assembly in which the switch contacts are electrically insulated from the actuating mechanism.

2 Claims, 2 Drawing Figures

SWITCH-VALVE ASSEMBLY HAVING ROTATABLE OPERATING MECHANISM WITH LATCH

BACKGROUND OF THE INVENTION

Valve and switch assemblies have been known for a number of years but with the recent emphasis on electric ignition systems for gas ranges interest in this type of assembly has increased substantially. Such assemblies should be as simple as possible in order to prevent failures, but at the same time, safe operation should be kept in mind. With recent requirements that a "child proof" gas burner valve be employed, the complexity of the actuating mechanism has increased, leading to substantial problems in designing a safe, trouble-free assembly.

Typical prior art devices are shown in U.S. Pat. Nos. 3,120,589; 3,502,835; 3,971,904; 4,002,866; and 4,002,872. While all the devices in these patents operate satisfactorily for their purpose, none disclose an operating mechanism which operates the assembly and has a latch mechanism associated with it to render the assembly "child proof".

SUMMARY OF THE INVENTION

It is thus an object to provide a switch mechanism for use with a valve having a rotatable operating stem. It is a further object of the present invention to provide an operating mechanism for the combination of such a switch mechanism and valve. It is another object of the present invention to provide an operating mechanism for a valve-switch assembly which exhibits the desired "child proof" feature; that is, the gas cannot be turned on without depressing the valve actuating knob and then rotating it.

In summary, these objects as well as others which will become apparent as the description of the invention proceeds, are accomplished by the switch assembly and operating mechanism of the invention. The switch assembly of the invention includes a housing having a bore therein which is aligned with a valve operating stem when it is seated against the valve housing. The switch housing has a pair of switch blades located therein which are actuated by an operating lever on the housing extending into the bore of the switch housing. The operating mechanism of the invention provides a cam cooperating with the operating lever on the switch housing to cause actuation and deactuation of the switch as a rotatable operating shaft upon which the cam is mounted is rotated. The rotatable operating shaft is axially collapsible which allows a tang or the cam to cooperate with an indentation on a latch plate to provide the "child proof" feature.

BRIEF DESCRIPTION OF THE DRAWINGS

During the course of the detailed description of the invention, reference will be made to the drawings in which:

In FIG. 1, the switch assembly and operating mechanism of the invention are shown in conjunction with a gas burner valve 10 having an inlet 12 and an outlet 14 formed in a housing 16. The structure of the burner valve 10 is well known. Accordingly, it will not be discussed in detail except to say that it is a plug type valve which is operated by rotating an integral operating stem 18 on the plug valve element 20.

Figure 1:
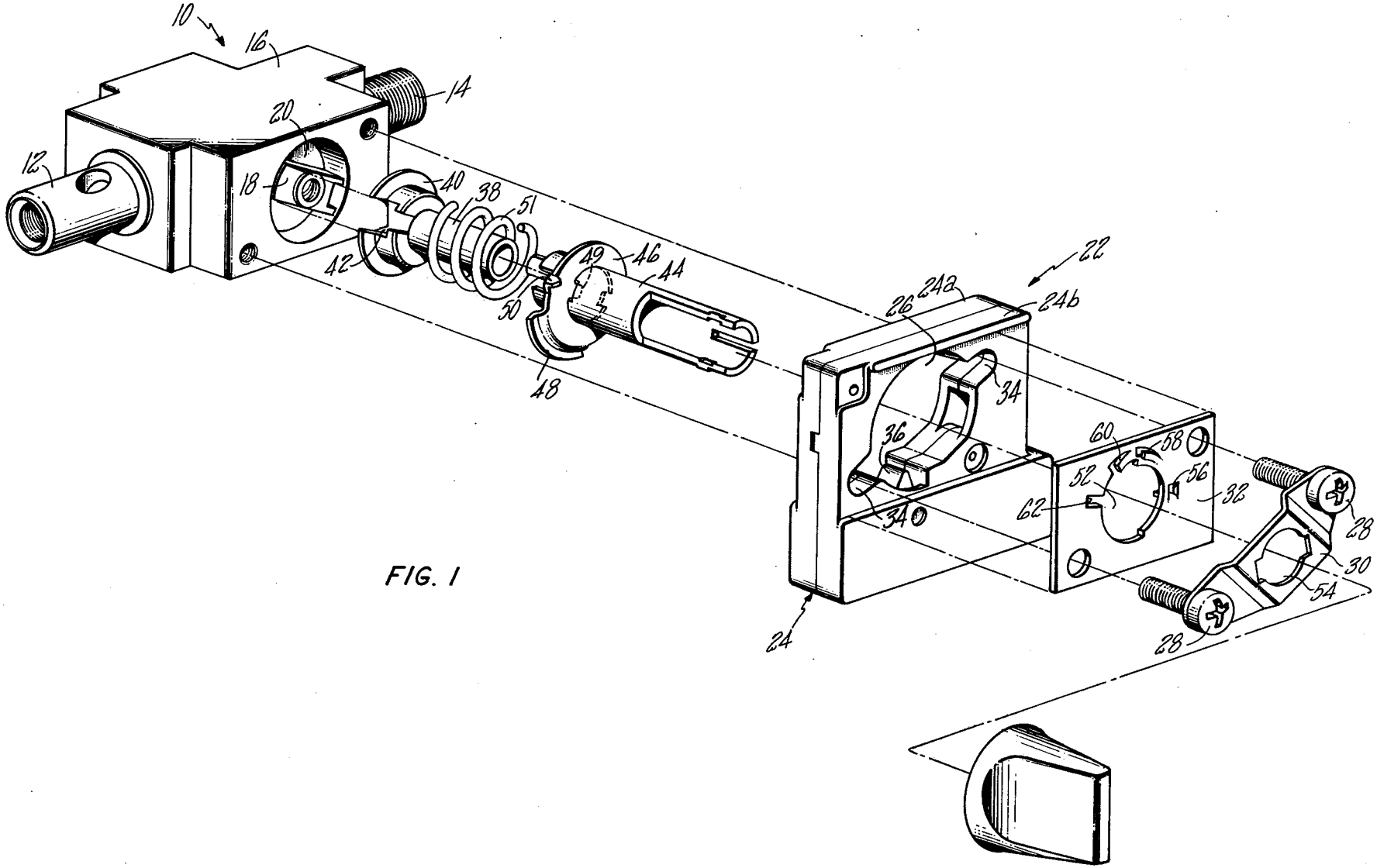
FIG. 1 is an exploded view in isometric, showing the valve assembly, switch assembly and operating mechanism.

A switch assembly generally indicated by reference numeral 22 includes a housing 24 consisting of housing parts **24*a* and 24*b*. The switch housing 24 has an axial bore 26 therein which is adapted to be axially aligned with operating stem 18 when the valve and switch housings 16 and 24, respectively, are assembled to one another. The entire assembly is held together by a pair of cap screws 28 which pass through a shaft guide member 30, a latch plate 32, peripheral notches 34 in the bore of the switch housing and are threaded into the housing 16 of the valve assembly 10. Operation of the switch assembly 22 is effected by an operating lever 36 pivotally mounted on the housing and having an end portion extending into the bore 26** of the switch housing.

An operating mechanism for both the valve and the switch assembly includes a first operating shaft 38 axially aligned with operating stem 18. The first operating shaft 38 includes a head portion 40 which is seated against the valve element 20 with the operating stem 18 situated in a diametric cutout 42 on the head 40. Thus, it will be appreciated that rotatable movement of the operating shaft 38 will cause the valve stem 18, and consequently the valve element 20, to likewise move rotatably. A second tubular operating shaft 44 is coaxially situated on the first operating shaft 38 and is coaxially located inside a cam member 46. As will be seen from the drawings, the cam 46 is washer shaped and has an integral peripheral camming surface 48 located thereon which cooperates with switch operating lever 36 to actuate the switch 22 whenever the operating mechanism is rotated. The cam 46 is attached to shaft 44 by suitable means such as an integral tab 49 in such a manner that it is prevented from rotating on shaft 44. In addition, the cam 46 has an integral tab 50 extending toward the switch assembly in a direction which is substantially perpendicular to the plane of the washer shaped cam. When the valve-switch assembly is assembled, cam 46 is located in bore 26 of the switch assembly. In the assembled condition, shaft 46 extends through bore 26 through aperture 52 in latch plate, and through aperture 54 in the shaft guide member 30. A compression spring member 51 is located primarily around shaft 38 between cap 40 and cam 46. It will thus be appreciated that the combination of shafts 38 and 44 and spring 49 results in an axially depressible or collapsible operating shaft.

A latching and indexing mechanism is formed by the cooperation of tang 50 with a plurality of indentations 56, 58, 60, and 62 around the periphery of aperture 52 in the latch plate. When the operating mechanism is rotated to the proper position, tang 50 is forced into indentation 56 to a sufficient extent that the operating mechanism cannot again be rotated without axially depressing or collapsing the shaft 44 to disengage tang 50 from indentation 56. Indentations 58 and 60 are not as deep as 56. Thus, they serve only to index the operating mechanism; that is, to provide some tactile feedback to the user relating to location of the mechanism. Notch 62 is not of sufficient width to lock the mechanism in place, but it does serve to index the mechanism also.

Figure 2:
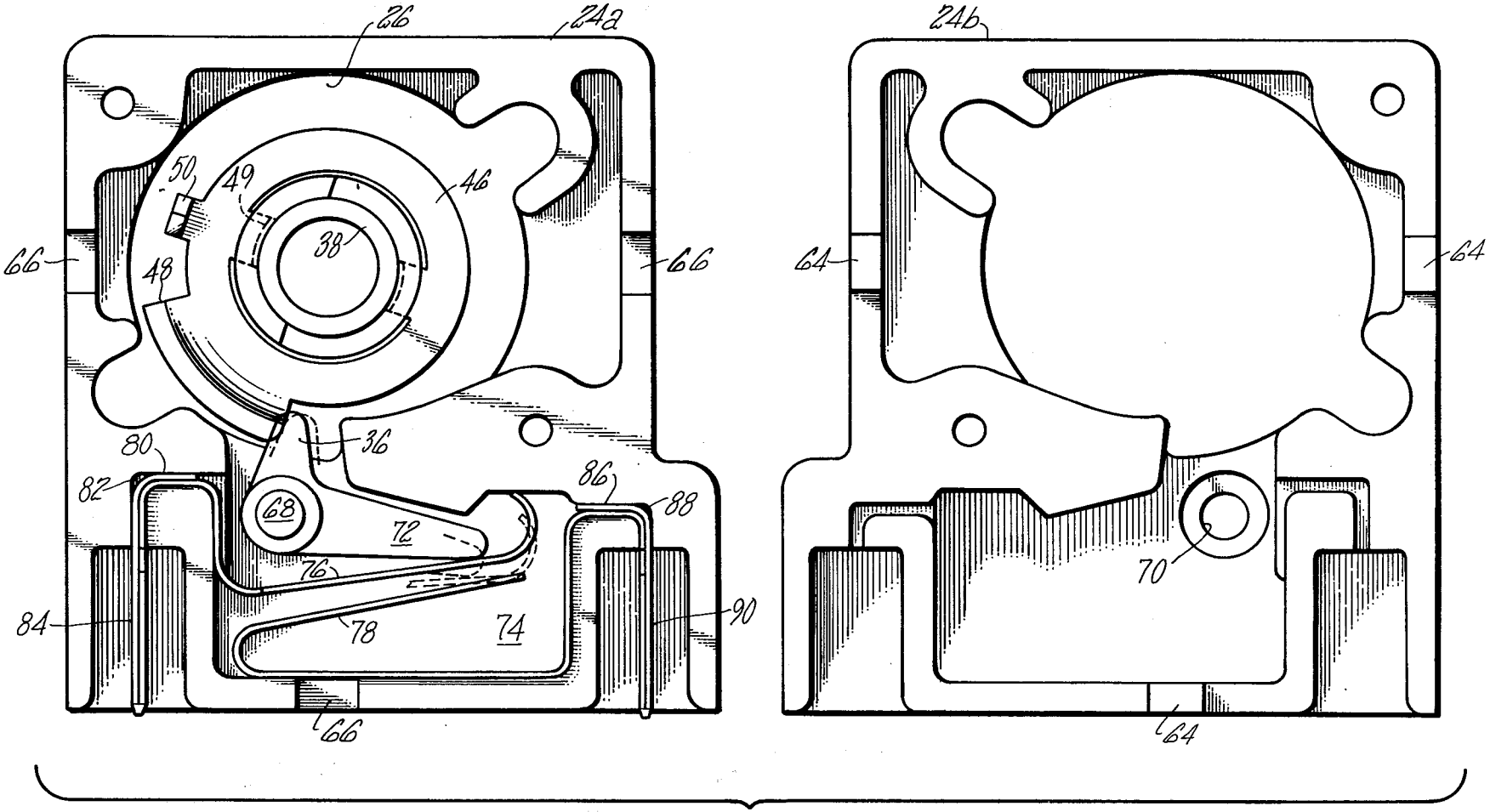
FIG. 2 is a view showing the switch housing opened and the interrelationship of the switching and switch actuating components.

In FIG. 2 the switch assembly 22 is shown with the two housing halves **24*a* and 24*b* separated from one another and with the operating mechanism shown in its positional relationship with the switch assembly. The housing halves 24***a* and 24*b* are substantially mirror images of one another except for a plurality of locking tabs 64 on housing half 24*b* which are received in corresponding locking recesses 66 in housing half 24*a*. Operating lever 36 is pivotally mounted in the switch housing 24 on integral shaft 68 which is suitably journalled in apertures 70 in the housing halves. In addition to the end portion of operating lever 36 extending into bore 26, the operating lever has a second end portion 72 extending into a switching cavity 74 formed in the switch housing. A pair of unitary, resilient switching members 76 and 78 are located in the switch cavity in spaced relationship to one another. Resilient switching blade 76 includes a mounting portion 80 which is situated in track-like recess 82 in the housing. The terminal portion 84 of switch blade 76 is of double thickness so as to provide the strength and thickness for attaching to it a corresponding female terminal. It will be noted that resilient switching blade 78 is formed in a similar manner, with its mounting portion 86 is formed in a similar manner, with its mounting portion 86 located in track-like recess 88 and a doubled terminal portion 90.

By now, operation of the switch assembly and operating mechanism of the invention should be clear to those skilled in the art. However, for sake of clarity, its operation will be briefly described. With the valve 10 and switch in the "off" position, the operating mechanism is located such that tang 50 is situated in latching aperture 56 in latch plate 32. Thus, the operating mechanism will be prevented from being rotated until shaft 44 is depressed against the bias of spring 51 to disengage tang 50 from latching indentation 56. After depression, the operation of mechanism can be rotated in a counterclockwise rotation and while such movement takes place, valve 10 will be opened. Continued rotation will place cam 46 in the position indicated in FIG. 2 at which point camming portion 48 will begin to pivot operating lever 36 around its shaft 68. Continued rotational movement of the operating mechanism will eventually position the components as shown in the dotted lines in FIG. 2 with switching blades 76 and 78 in contact with one another so as to complete an electrical circuit between terminals 84 and 90.

It will be clear to those skilled in the art that the assembly described herein is particularly adapted for use in a gas range wherein operation of the switch assembly is synchronized with operation of the valve assembly to control an electrical ignition device for the burner associated with the valve. It will also be clear, however, that the principles of the present invention may be applied elsewhere. Accordingly, it is intended that the scope of the invention be defined in the claims.

What is claimed is:

1. A combination valve-switch assembly, which comprises:

a valve housing;

a rotatable operating stem extending from said valve housing;

a switch assembly including an insulating housing seated against said valve housing, an axial bore through said insulating housing aligned axially with said rotatable operating stem, switch blades enclosed in said housing, electrically insulated switch operating means on said housing extending radially into said bore for moving said switch blades into contact with one another;

an axially compressible, rotatable, operating mechanism axially aligned with said operating stem, and extending axially through said bore;

latch means for preventing rotatable movement of said operating mechanism; and a cam mounted on said operating mechanism and arranged to cooperate with said switch operating means.

2. The assembly as claimed in claim 1, wherein said latch means comprises:

a latch plate on said switch housing including a bore axially aligned with the bore in said switch housing, the bore in said latch plate being of smaller diameter than the bore in said switch housing, an indentation in said latch plate near the periphery of said bore; and a tang on said cam cooperating with said indentation to prevent rotatable movement of said operating mechanism whenever said mechanism is rotated to a first position and is axially extended.

* * * * *